US007850459B1

(12) United States Patent
Kernahan et al.

(10) Patent No.: US 7,850,459 B1
(45) Date of Patent: Dec. 14, 2010

(54) APPARATUS FOR MECHANICALLY ATTACHING TWO STRUCTURES AND OPTIONALLY MAKING ELECTRICAL CONNECTIONS BETWEEN ELECTRONIC DEVICES

(75) Inventors: Kent Kernahan, Cupertino, CA (US); Mika Nuotio, Sunnyvale, CA (US); Christopher Caldwell, Santa Clara, CA (US)

(73) Assignee: Array Converter, Inc., Sunnyvale, CA (US)

( * ) Notice: Subject to any disclaimer, the term of this patent is extended or adjusted under 35 U.S.C. 154(b) by 28 days.

(21) Appl. No.: 12/502,524

(22) Filed: Jul. 14, 2009

(51) Int. Cl.
*H01R 12/00* (2006.01)

(52) U.S. Cl. ..... 439/65

(58) Field of Classification Search ..... 439/65, 439/801, 805, 802, 665, 735, 784; 174/166 S
See application file for complete search history.

(56) References Cited

U.S. PATENT DOCUMENTS 2,726,280 A * 12/1955 Demurjian ..... 174/166 S
4,354,725 A * 10/1982 Herbaugh et al. ..... 439/736
5,474,460 A * 12/1995 Tirrell et al. ..... 439/121
6,227,914 B1 * 5/2001 Lee et al. ..... 439/754
7,074,095 B2 * 7/2006 Perng ..... 439/766
7,354,306 B2 * 4/2008 Thorner ..... 439/578
7,491,077 B1 * 2/2009 Yang ..... 439/241
7,553,182 B2 * 6/2009 Buck et al. ..... 439/378
7,572,133 B2 * 8/2009 Hughes et al. ..... 439/181

* cited by examiner

*Primary Examiner*—Alexander Gilman
(74) *Attorney, Agent, or Firm*—Michael W. Caldwell

(57) ABSTRACT

A base unit is mechanically connected to the structure of a first electronic device. The base unit is round and includes conductive threads around the inside surface of an outer ring. The base unit may also include a center threaded post with conductive threads. The first electronic device is electrically connected to the base unit. A replaceable unit is sized such that it may screw into the base unit, the replaceable unit including matching threads which engage with the threads of the base unit. The threads of the replaceable unit are also electrically conductive, and are electrically connected to a second electronic device which is encapsulated within the replaceable unit. When the two pieces are screwed together the two electronic devices are thereby electrically connected. The first electronic device may be a solar panel. Another version of the invention does not include electrical connections.

5 Claims, 5 Drawing Sheets

APPARATUS FOR MECHANICALLY ATTACHING TWO STRUCTURES AND OPTIONALLY MAKING ELECTRICAL CONNECTIONS BETWEEN ELECTRONIC DEVICES

BACKGROUND

Structures have been connected using a nut and bolt for centuries. However such mechanical connections may be limited by the strength of the engaged threads. To increase resistance to being pulled apart one may use a harder, more expensive material and/or increase the size of the nut and bolt. It would be useful were one able to increase the pull strength without using more expensive material or increasing size, especially in tight areas.

Electronic devices are sometimes used in harsh environments of extreme temperature, moisture, pressure, vacuum sunlight, attacking gases, or harsh chemicals. Protecting the electronics can be even more difficult when the electronics are not a closed mechanical system, but must be electrically connected to another system. It would be particularly useful for an attachment apparatus that can be attached to a load or controlled device, then an electronic device attached and connected such that it is environmentally secure, but the electronics can later be replaced if need be.

SUMMARY

The present invention provides an improvement in the force trying to pull apart two structures secured by a nut and a bolt by providing two sets of engaged threads rather than one. An outer member, functioning in a manner similar to a nut, includes a set of threads on the inner surface of an outer ring plus a center member with identical threads about its outer surface. The outer ring and center member are connected by material spanning the two, thus an inserted (screwed in) member corresponding to the function of a bolt screws into the outer member but cannot go beyond the connecting material. The inserted member has threads on its outer surface and in a center hole, all threads corresponding to the threads of the outer member. Thus, when screwed together, two sets of threads resist pulling the two apart, providing superior holding power, as well as allowing for additional torque compared to a conventional nut and bolt. In some embodiments there are more than two sets of threads, thus providing even more strength and torque capability.

In another configuration, the present invention provides for an electro-mechanical system somewhat similar to the fashion in which an electric light bulb is connected to its base, power, and on/off switch. According to the present invention a base unit is connected securely to the structure of a first electronic device and electrical connections brought into the base unit. The base unit includes one or more threaded surfaces, wherein the threaded surfaces are conductive or include an area that is conductive. A second electronic device to be connected to the first electronic device is manufactured inside a replaceable unit that has threads matching those of the base unit. The threads of the replaceable unit are also conductive, or include an area that is conductive. The second electronic device is electrically connected to the threads. Later, such as at the end of a production line or during field installation, the replaceable unit is screwed into the base unit, whereby the second electronic device makes electrical contact with the base unit (thereby to the first electronic device). The base unit and the replaceable unit are manufactured such that when the two are screwed together a tight seal is formed. Should the electronics in the replaceable unit fail, the replaceable unit may be unscrewed and a new unit screwed in. If the first electronic device should fail, the replaceable unit can be removed and used on a different unit.

The first electronic device can be any electronic or electrical device, for example a solar panel.

DETAILED DESCRIPTION OF THE INVENTION

Definition of Some Terms

| | |
|---|---|
| PCB | Printed Circuit Board |
| IDC | Insulation Displacement Connector. Allows making an electrical connection by pressing an insulated wire between two conductive members, which cut through the insulation to make contact with the wires within. |

Figure 1:
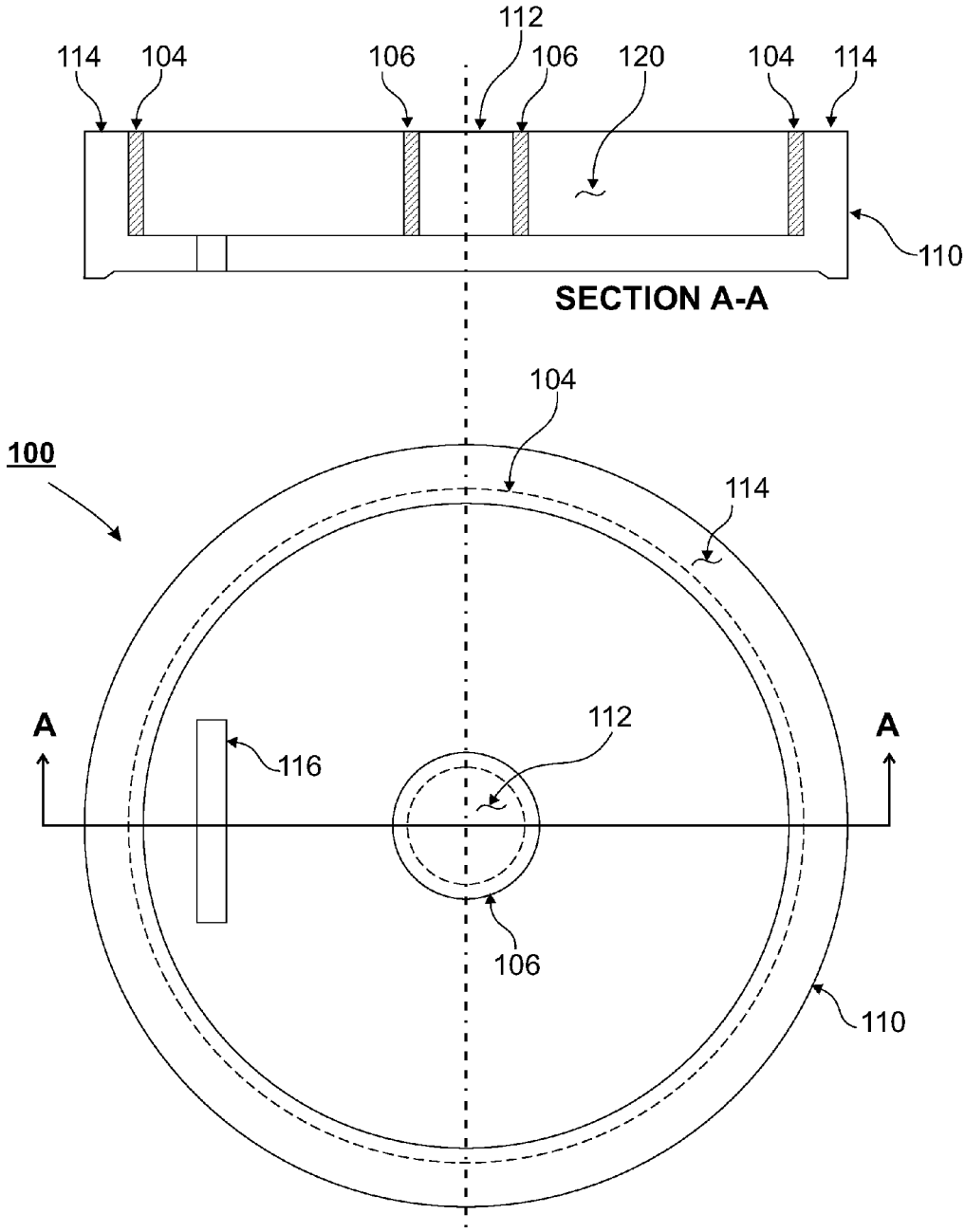
FIG. 1 is a top view and a cross section of a base unit according to the present invention.

Looking to FIG. 1, a base unit 100 is shown both looking down upon it (that is, looking into the opening end) and in cross section. In this disclosure we may refer to "top" and "bottom" orientations. Such references are only relative to the illustrative figures; the physical units when used according to the present invention may be of any orientation. The base unit comprises a round outer shell 110. In some embodiments a center piece 112 is molded as part of the outer shell 110. The top edge of the outer shell is thick enough to be sturdy such that when the replaceable part (discussed later) is screwed into the outer shell 110 the shell 110 can withstand the side pressure. In other embodiments a center piece 112 is produced separately from the outer shell 110, then attached to the outer shell 110 by adhesive, a center pin into the floor of the outer shell, or is threaded into a matching threaded hole in the outer shell 110 (not shown). In some embodiments there is no center piece 112.

Around at least part of the inside perimeter of the outer shell 110 are threads 104. The threads 104 may be formed during molding of the outer shell 110 and conductive inserts later placed in the threads 104. In some embodiments the outer shell inside perimeter is smooth, and the threads 104 are a separate, threaded metal piece that fits into the outer shell 110. In similar fashion, the a center piece 112 includes threads 106, wherein the threads 1106 maybe be molded into the center piece material 112 and conductive material added, or the center piece is smooth and the threads 106 are a threaded cylindrical metal piece that slides down over the smooth center piece 112. Other methods will be known to one familiar with the art, wherein a threaded outer and inner (112) part may be constructed such that at least some portion of the threads are electrically conductive.

Figure 2:
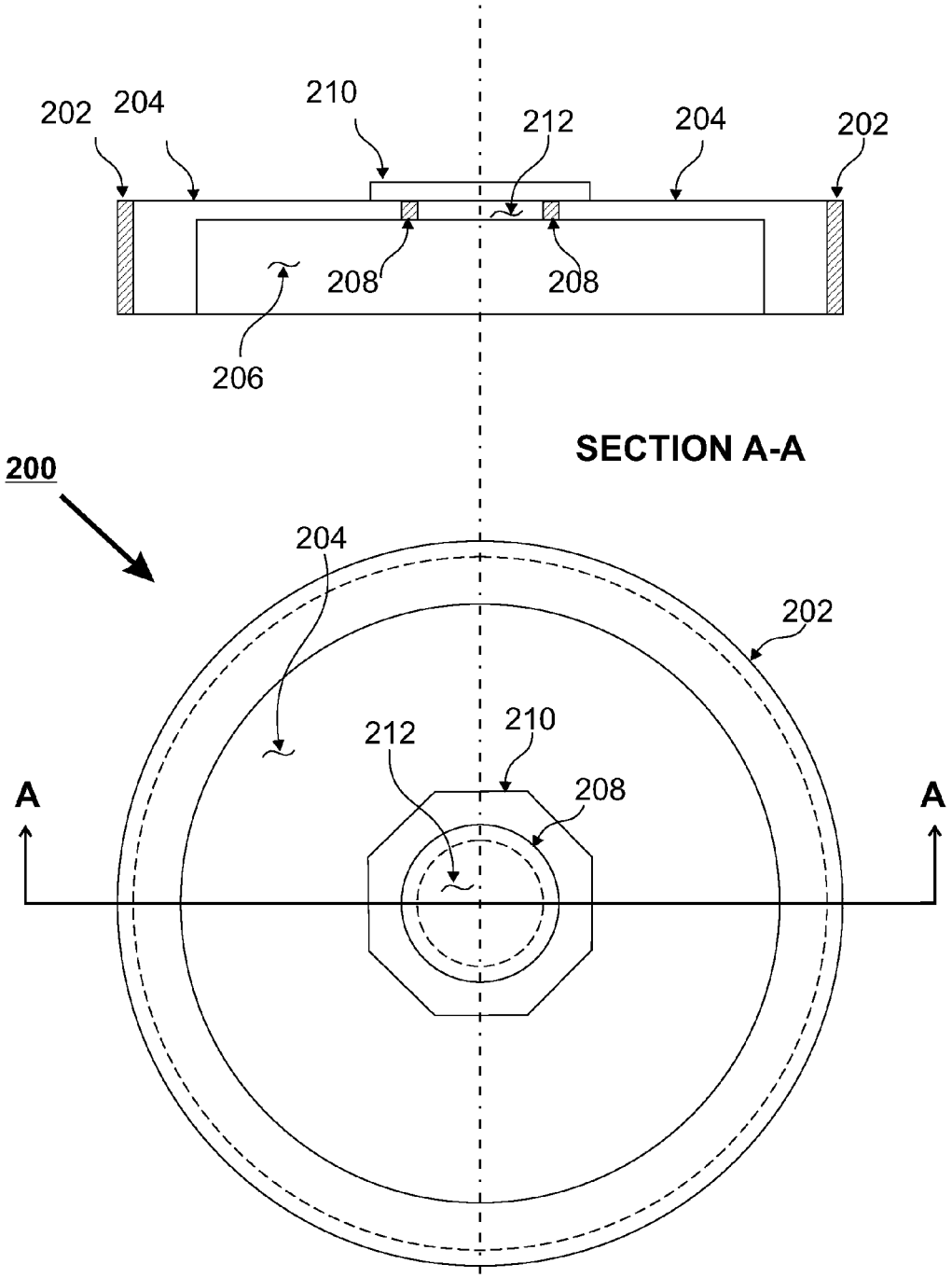
FIG. 2 is a top view and a cross section of a replaceable unit according to the present invention.
Figure 3:
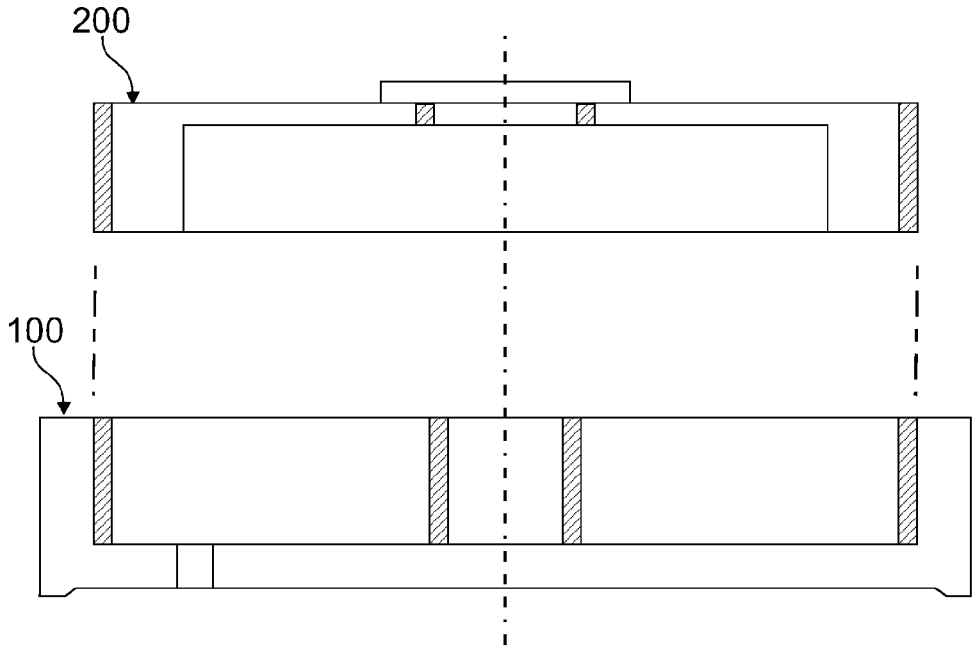
FIG. 3 illustrates how a base unit and a replaceable unit would be assembled together.

FIG. 2 illustrates a replaceable unit 200 according to the present invention. The replaceable unit 200 is designed and fabricated such that it can screw into the base unit 100. The height of the base unit 100 and the replaceable unit 200 are such that the replaceable unit 200 can hold and completely encapsulate an electronic device (not shown in FIG. 2). The replaceable unit 200 comprises a body 204, with threads 202 on the outside rim of the body 204. In embodiments of the base unit 100 wherein the base unit includes a threaded center piece 112, the replaceable unit 200 includes a hole with threads 208, wherein the treads 208 match the threads 106 of the base unit 100. In some embodiments the replaceable unit 200 includes a molded nut shape 210 on the surface, providing means for the replaceable unit 200 to be tightened upon installation, or to be removed, using a common wrench. In other embodiments the top surface of the replaceable unit 200 has two or more holes molded into it (but not through to the cavity 206) such that a forked tool (not shown) may engage the holes to provide extra torque when installing or removing a replaceable unit 200.

In some embodiments the threads 104/202 or 106/208 of the base 100 and the replaceable unit 200 are somewhat tapered, similar to pipe threads, wherein the threads will bind and tighten down when the replaceable unit 200 is screwed into the base unit 100 a desired amount. In some embodiments the threads 104/202 or 106/208 are like machine threads, having the same diameter along the center axis of the body 100 and replaceable unit 200. One skilled in the art will know of other means for forming threads on the two units 100,200 such that they may later be taken apart nondestructively, while providing a tight fit in service.

In some circumstances it may be necessary for the replaceable unit to have a particular orientation relative to the base unit 100, hence the structure of the first electronic device. This is sometimes accomplished by manufacturing base 100/replaceable unit 200 pairs that have a particular orientation when screwed together. In one embodiment the threads 104/106 comprise a plurality of thread sets and the appropriate thread set selected when screwing the replaceable unit 200 into the base unit 100 to provide the desired final orientation. For example, in one embodiment there are four sets of threads 104/106 on the base unit 100 provided, each with a thread entry point that is ninety (90) degrees apart from the thread entries on either side. If each thread goes around a whole number of times, for example two, then one may select the final orientation of a replaceable unit 200 upon installation by selecting a thread set 104,106 with its opening corresponding to the final orientation.

For example, consider a configuration wherein the conductive threads 104 on the inner surface of the outer ring 110 of the base unit 100 are segmented, rather than a continuous thread around the inner surface, the threads 104 comprising four segments, each electrically isolated from the other, and each with a unique connection to the first electrical device. Now consider that the electrically conductive threads 202 of the replaceable unit 200 are similarly segmented. By selecting which set of threads 104 to engage when screwing the two units 100, 200 together one would also select how the two electronic devices are connected. In another example, consider the arrangement of connectors in the base 100 similar to FIG. 5, wherein a series of conductive leads 504 are provided within the base 508, each lead 504 electrically isolated from the others, and each with a particular orientation. Again, by selecting which set of threads the replaceable unit 200 enters in, one can determine which conductor 504 makes contact with the electrical device within the replaceable unit 200. Of course one would be able to vary how many segments, what connections, and such are designed into a given device set to provide for a variety of electrical connection possibilities.

Figure 7:
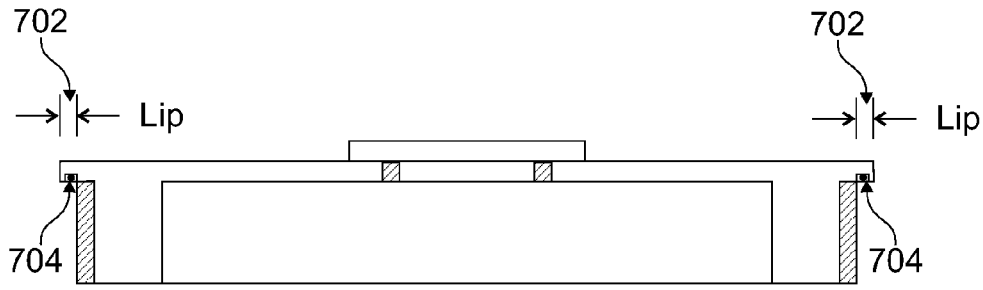
FIG. 7 shows an example of an alternative embodiment including a lip and a seal.

In one embodiment the replaceable unit 200 has a lip 702 on the top part (see FIG. 7) with a flexible seal 704, such as an O-ring, that is compressed down against the top surface 114 of the base 100 when the base 100 and replaceable unit 200 are tightened against each other.

Figure 4:
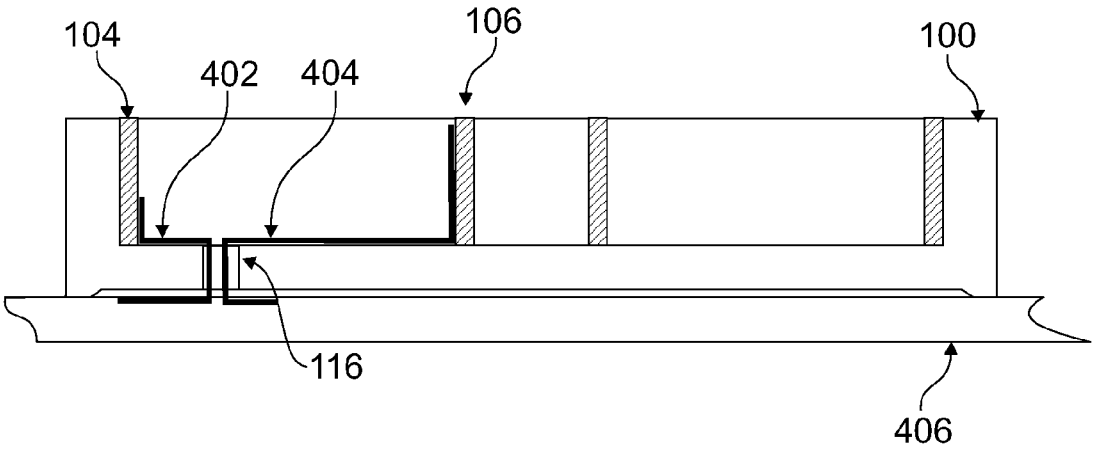
FIG. 4 shows one example of how electrical connections are made between a controlled product and a base unit.

FIG. 4 is an example of one method for electrically connecting the structure of the first electronic device 406 with the conductive threads 104 and 106 of the base 100. In the illustration of FIG. 4, the structure 406 is considered to also be electrically connected to the first electronic device. For example, the structure 406 could be the back side of a solar panel, with electrical leads manufactured into the solar panel on its back side for connection to control electronics in the replaceable unit 200. A lead 402 is brought in through an access hole 116 in the base 100 and brought up to the inside surface of the threads 104. Likewise another lead 404 is brought up from the structure 406 and routed to the threads 106 on the outside surface of the center piece 112. In other embodiments the leads 402 or 404 are premade in conjunction with the threads 106 and/or 106 by spot welding or otherwise connecting to the conductive threads. In one embodiment the leads are connected to the controlled product and during attachment of the base 100 to the controlled product 406 the leads 402, 404 are brought up through the access hold 116 and connected to the threads 104, 106 by solder, spot welding, or connectors. So, according to the present invention, the base 100 is preinstalled on the structure of the first electronic device. The replaceable until 200 may be attached at the same time as when the base unit 100 is attached to the controlled product, or the assembly comprising the first electronic device structure and base unit 100 may be shipped or set aside and the replaceable unit 200 added at another time.

Figure 5:
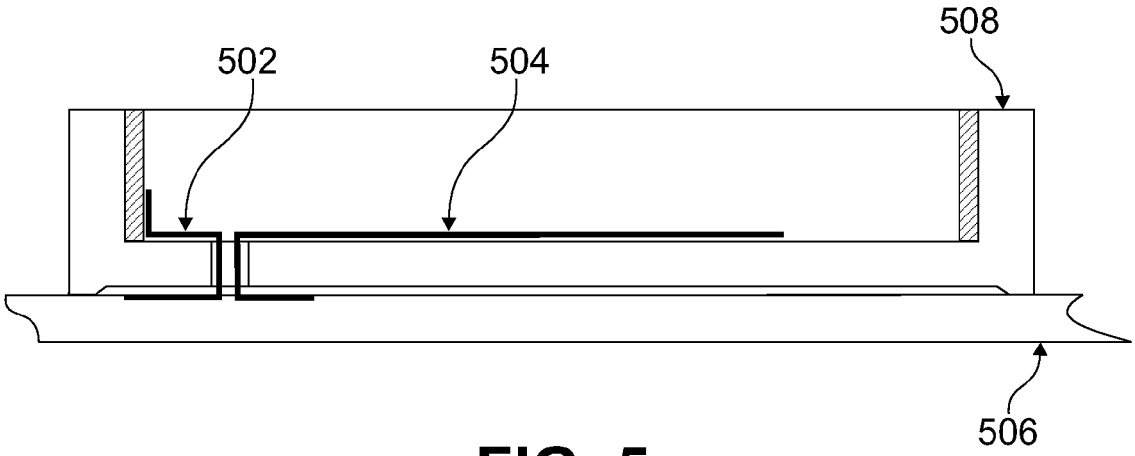
FIG. 5 is an alternative method for electrically connecting a base unit and a controlled product.

FIG. 5 shows an alternative embodiment wherein the base 508, corresponding to the base 100, does not have a center piece 112. A lead 502, corresponding to the lead 402 (including all the alternative embodiments and techniques described) and a second lead 504, wherein the second lead 504 is on the bottom floor of the cavity of the base unit 508. As previously described, the base 508 is attached to the structure of the first electronic device 506.

The base unit 100 is affixed to the structure of the first electronic device by a strong, waterproof adhesive, such as RTV rubber or epoxy, between the base 100 and the structure. In one embodiment the base unit has bosses (not shown) for a nut and bolt attachment between the base unit 100 and the structure. In another embodiment, screws go through the floor of the base unit 100 into the body of the structure. There are many similar, suitable attachment methods one skilled in the art will know.

Figure 6:
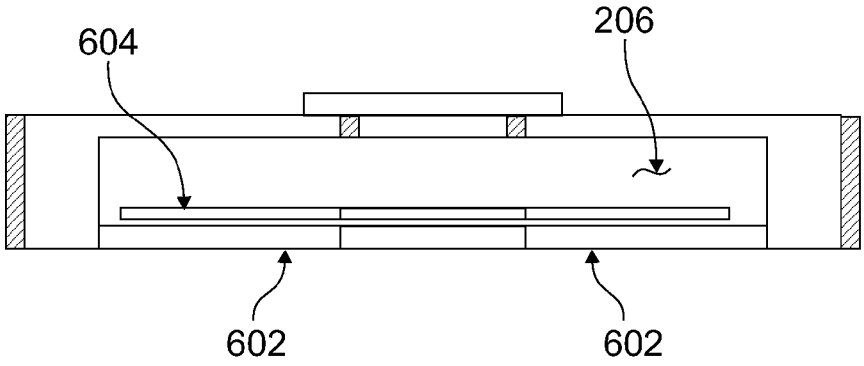
FIG. 6 shows one example of how a printed circuit board, comprising the electronics, may be manufactured inside of a replaceable unit.

Looking to FIG. 6, a PCB 604 comprising the second electronic device is within the replaceable unit 200. In some embodiments a bottom plate 602 is attached to the replaceable unit, the PCB 604 affixed to the bottom plate 602. In another embodiment the PCB 604 is placed inside the cavity 206, connected appropriately, then potted with RTV or another potting media. In one embodiment the PCB 604 and its electronics are molded into the replaceable unit 200 at the time of manufacture of the replaceable unit 200. During manufacture of the replaceable unit 200 and electronics 604 as a set (that is, as a complete unit) the electronics will have one or more electrical connections made between the PCB 604 and the threads 202, 208 by methods similar to those of the base unit 100 thread 104, 106 electrical connections. In one embodiment, previously mentioned, the base 100 does not include a center piece 112, and provides a connection on the base unit 100 floor, exemplified in FIG. 5. In such a construction the replaceable unit 200 does not have a hole 212, and a connection is made between the PCB 604 and the bottom of the replaceable unit 200 (such as bottom plate 602), such that the PCB 604 lead connection makes contact with the base 100 lead 504 when the replaceable unit 200 is screwed into the base 508 (100).

In another embodiment IDCs are affixed to the replaceable unit 200. The IDCs may be internal (in the cavity 206) or on the top surface 204. The IDCs are electrically connected to the second electronic device, and provide for the leads from the first electronic device to be brought out from the base unit 100 and connected to the IDCs. In one embodiment multiple sets of IDCs are provided, with some electrically connected to different points of the second electrical device, thus providing for a selection of functions depending upon which IDCs are used.

Figure 8:
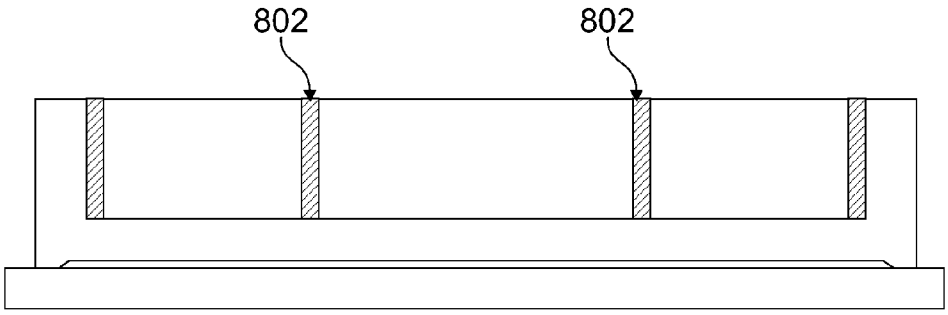
FIG. 8 is an example of a non-electrical use of the present invention.
Figure 9:
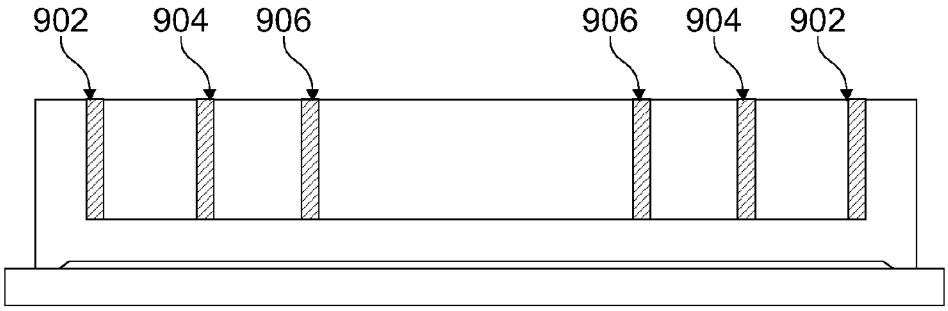
FIG. 9 is an alternative embodiment of the apparatus of FIG. 8.

Looking to FIG. 8, a non-electrical embodiment is shown. Only the base is shown; the matching unit has corresponding threaded structures. Due to the extra set of threads 804 compared to a conventional nut and bolt, the mechanical connection of the present invention provides additional resistance to pulling apart and/or greater torque capability. The number of sets of threads so engaged may be an arbitrary number. For example, FIG. 9 illustrates three sets of threads 902, 904, 906, providing greater strength that that of FIG. 8 or a conventional nut and bolt for a given common material and physical size. Note that the electrically connecting versions of the invention, such as described in FIG. 1 through FIG. 7, may also have more than two treaded, mating, electrically connecting surfaces similar to the configuration of FIG. 9.

One skilled in the art will know of many methods alternative in their details for attaching a base unit 100 to a structure, the replaceable unit 200 to the base unit 100, the threads 104, 106, 202, 208 to their respective units, and of attaching electrical leads to the units. All such variations are within the scope of the present invention. The details disclosed hereinbefore are to be taken as examples, not specific limitations of the scope of this disclosure.

What is claimed is:

1. An apparatus for mechanically and electrically connecting two electronic devices, comprising:

a base unit, wherein the base unit is mechanically connected with a structure including a first electronic device, the base unit comprising:

a round outer ring, the outer ring including a threaded, electrically conductive inner surface;

a connecting piece spanning the outer ring;

an opening in the connecting piece for through-passage by a first electrical lead wherein the first electrical lead is electrically connected between the first electronic device at one end and the threaded, electrically conductive inner surface at the other end; and a center post comprising a threaded, electrically conductive outer surface, the center post oriented along an axis of the outer ring and perpendicular to the connecting piece, wherein a second electrical lead through the opening in the connecting piece is electrically connected between the first electronic device at one end and the threaded, electrically conductive outer surface at the other end; and a replaceable unit comprising:

an outer ring, the outer ring including a threaded, electrically conductive outer surface;

a connecting piece spanning the outer ring, thereby forming a cavity bounded by the outer ring and the connecting piece, wherein the connecting piece has an opening at the center of the connecting piece corresponding to the position of the center post, the opening including an electrically conductive inner surface;

a second electronic device within the cavity, wherein the electronic device has a first electrical lead electrically connected to the electrically conductive outer surface of the outer ring and a second electrical lead electrically connected to the electrically conductive inner surface of the opening;

wherein a diameter of the inner surface of the outer ring of the base unit corresponds to a diameter of the outer surface of the outer ring of the replaceable unit and further wherein the diameter of the outer surface of the center post of the base unit corresponds to the diameter of the opening at the center of the connecting piece of the replaceable unit, wherein all threads are of the same pitch such that the replaceable unit may be screwed into the base unit, thereby forming one assembled unit.

2. The apparatus of claim 1, further including one or more insulation displacement connectors mechanically connected with the replaceable unit, wherein the one or more insulation displacement connectors are electrically connected to the second electronic device.

3. The apparatus of claim 1, wherein the threads of the inner surface of the outer ring of the base unit comprise a plurality of inner thread sets and the threads of the outer surface of the center post of the base unit comprise a plurality of outer thread sets wherein the number of inner thread sets and outer thread sets are the same and further wherein points of entry of the inner thread sets and the outer thread sets are aligned.

4. An apparatus for mechanically connecting two structures, comprising:

a base unit, wherein the base unit is connected with a first structure, the base unit comprising:

a round outer ring, the outer ring including a threaded inner surface;

a connecting piece spanning the outer ring; and a center post comprising a threaded outer surface, the center post oriented along an axis of the outer ring and perpendicular to the connecting piece; and a corresponding connecting unit connected with a second structure, comprising:

an outer ring, the outer ring including a threaded outer surface;

a connecting piece spanning the outer ring, thereby forming a cavity bounded by the outer ring and the connecting piece, wherein the connecting piece has an opening at the center of the connecting piece corresponding to the position of the center post of the base unit;

wherein a diameter of the inner surface of the outer ring of the base unit corresponds to a diameter of the outer surface of the outer ring of the connecting unit and further wherein the diameter of the outer surface of the center post of the base unit corresponds to the diameter of the opening at the center of the connecting piece of the connecting unit, wherein all threads are of the same pitch such that the connecting unit may be screwed into the base unit, thereby mechanically connecting the first and the second structures.

5. The apparatus of claim 4, further including additional sets of inner and outer threads.

* * * * *